US007347346B1

(12) United States Patent
Frankel

(10) Patent No.: US 7,347,346 B1
(45) Date of Patent: Mar. 25, 2008

(54) SHIRT SHOULDER SHAPING SYSTEM

(76) Inventor: Robert I. Frankel, 4234 Red Bud Pl., Cincinnati, OH (US) 45229

( * ) Notice: Subject to any disclaimer, the term of this patent is extended or adjusted under 35 U.S.C. 154(b) by 0 days.

(21) Appl. No.: 11/581,100

(22) Filed: Oct. 10, 2006

(51) Int. Cl.
*A41D 27/22* (2006.01)

(52) U.S. Cl. ..... 223/98; 223/85

(58) Field of Classification Search ..... 223/85, 223/87, 88, 89, 92, 94, 98; D6/315, 318, D6/319, 328
See application file for complete search history.

(56) References Cited

U.S. PATENT DOCUMENTS

| | | | | | |
|---|---|---|---|---|---|
| 2,335,285 | A | * | 11/1943 | Kinney | 223/89 |
| 2,591,163 | A | * | 4/1952 | Kivett | 223/98 |
| 2,596,576 | A | * | 5/1952 | MacSpadden | 223/88 |
| 2,597,509 | A | * | 5/1952 | Mallory | 223/88 |
| 2,601,442 | A | * | 6/1952 | Mallory | 223/88 |
| 2,620,102 | A | * | 12/1952 | Bremer | 223/89 |
| 2,709,026 | A | * | 5/1955 | MacKenzie | 223/88 |
| 2,820,583 | A | * | 1/1958 | Mills | 223/88 |
| 2,884,171 | A | | 4/1959 | Knuth | |
| 3,680,748 | A | | 8/1972 | Brunhuber | |
| D234,243 | S | * | 2/1975 | Lindemann | D6/328 |
| 4,007,861 | A | * | 2/1977 | Duester et al. | 223/85 |
| 4,066,193 | A | * | 1/1978 | Davis, Jr. | 223/88 |
| 4,184,616 | A | * | 1/1980 | Davis, Jr. | 223/98 |
| 4,753,355 | A | | 6/1988 | Hall et al. | |
| 5,056,694 | A | * | 10/1991 | Michalik | 223/98 |
| D348,359 | S | | 7/1994 | Hasselbeck | |
| 6,138,880 | A | * | 10/2000 | Williams | 223/98 |
| 6,688,502 | B2 | * | 2/2004 | Kunreuther | 223/85 |
| D503,287 | S | * | 3/2005 | Gouldson | D6/328 |
| 7,124,920 | B2 | * | 10/2006 | Gustafson et al. | 223/98 |
| 2004/0084488 | A1 | * | 5/2004 | Gustafson et al. | 223/98 |
| 2005/0115993 | A1 | | 6/2005 | Miura | |

* cited by examiner

*Primary Examiner*—Gary L. Welch
*Assistant Examiner*—Nathan E Durham

(57) ABSTRACT

A shirt shoulder shaping system for distributing weight of a shirt over a greater area to shape shoulders of the shirt and inhibit a clothes hanger from damaging the shirt includes a pair of arm assemblies being attached to a clothes hanger. The clothes hanger has a pair of sides each having one of the arm assemblies attached thereto to distribute the weight of the shirt over a greater area. Each of the arm assemblies includes a cover positioned over one of a pair of descending arms of the clothes hanger. The cover distributes a portion of the weight of the shirt over the cover when the shirt is hung on the clothes hanger. Each of a pair of mounting clips is coupled to a bottom surface of the cover and engages the associated one of the descending arms to secure the cover to the clothes hanger.

11 Claims, 6 Drawing Sheets

SHIRT SHOULDER SHAPING SYSTEM

BACKGROUND OF THE INVENTION

1. Field of the Invention

The present invention relates to hanger attachments and more particularly pertains to a new hanger attachment for distributing weight of a shirt over a greater area to shape shoulder of the shirt and inhibit a clothes hanger from damaging the shirt or putting hanger marks on the shirt.

2. Description of the Prior Art

The use of hanger attachments is known in the prior art. The prior art commonly teaches a cover that is coupled to a side of and extends over the side of a clothes hanger. While these devices fulfill their respective, particular objectives and requirements, the need remains for a system that has certain improved features that engage a bottom bar of a clothes hanger to inhibit rotation of a cover around a descending arm of the clothes hanger. Additionally, the system may be adjusted to accommodate shirts that are larger and may not fit properly on the clothes hanger.

SUMMARY OF THE INVENTION

The present invention meets the needs presented above by generally comprising a pair of arm assemblies being attached to a clothes hanger. The clothes hanger has a pair of sides each having one of the arm assemblies attached thereto to distribute the weight of the shirt over a greater area of the shirt. Each of the arm assemblies includes a cover positioned over one of a pair of descending arms of the clothes hanger. The cover distributes a portion of the weight of the shirt over the cover when the shirt is hung on the clothes hanger. Each of a pair of mounting clips is coupled to a bottom surface of the cover. The mounting clips engage the associated one of the descending arms of the clothes hanger to secure the cover to the associated one of the descending arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
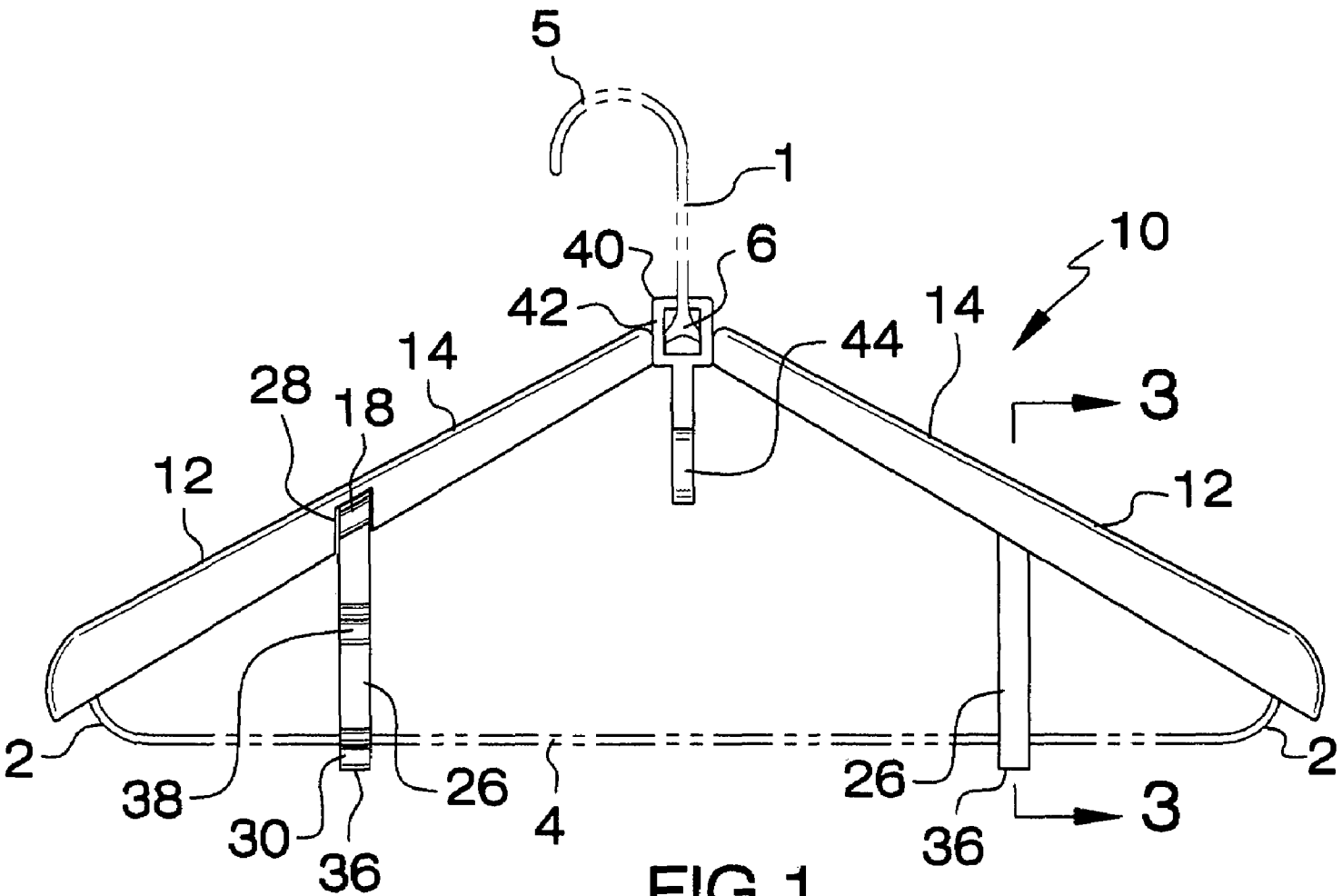
FIG. 1 is a front view of a shirt shoulder shaping system according to the present invention.
Figure 3:
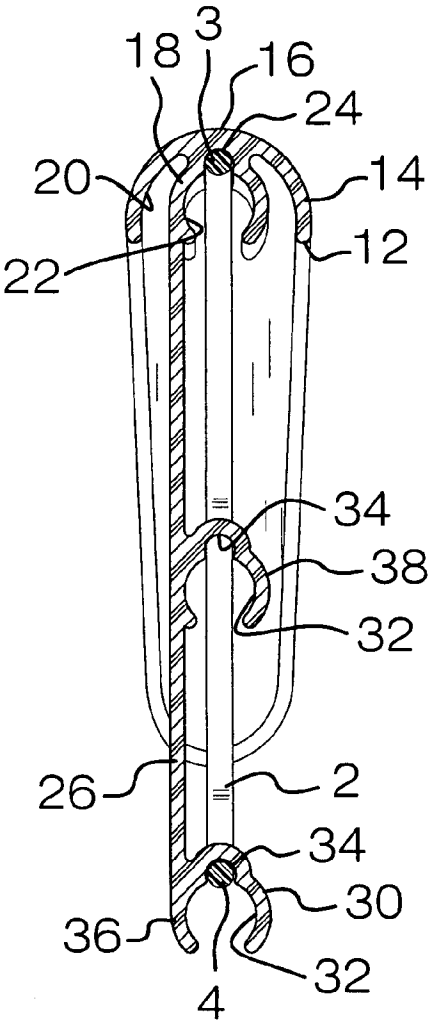
FIG. 3 is a cross-sectional view of the present invention taken along line 3-3 of the FIG. 1.
Figure 2:
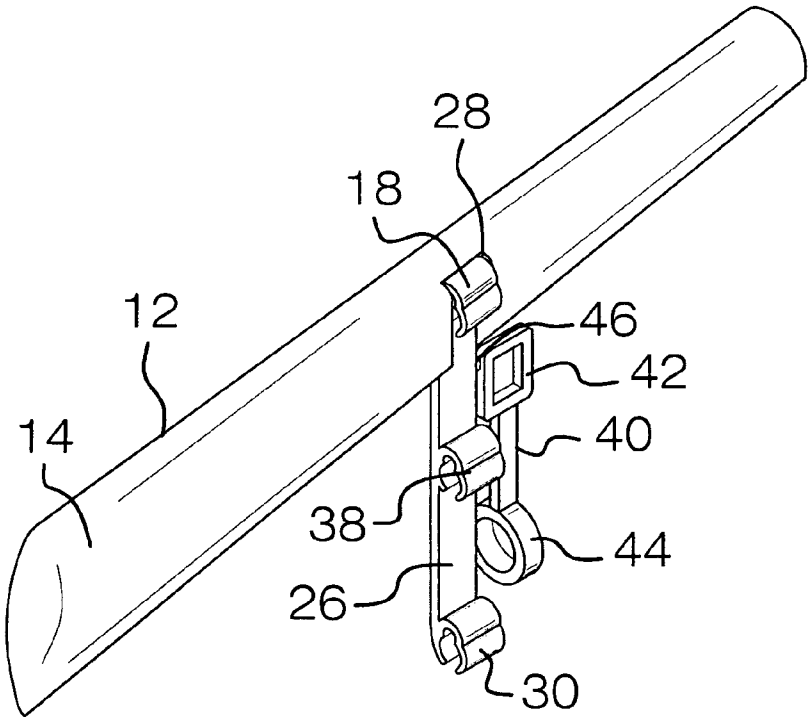
FIG. 2 is a perspective view of one of the arm assemblies of the present invention.
Figure 4:
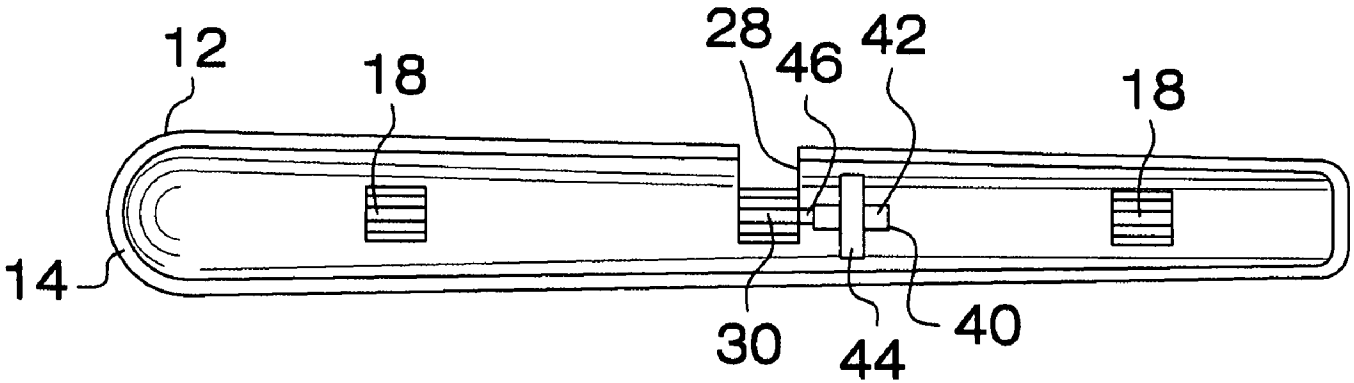
FIG. 4 is a bottom view of one of the arm assemblies of the present invention.
Figure 5:
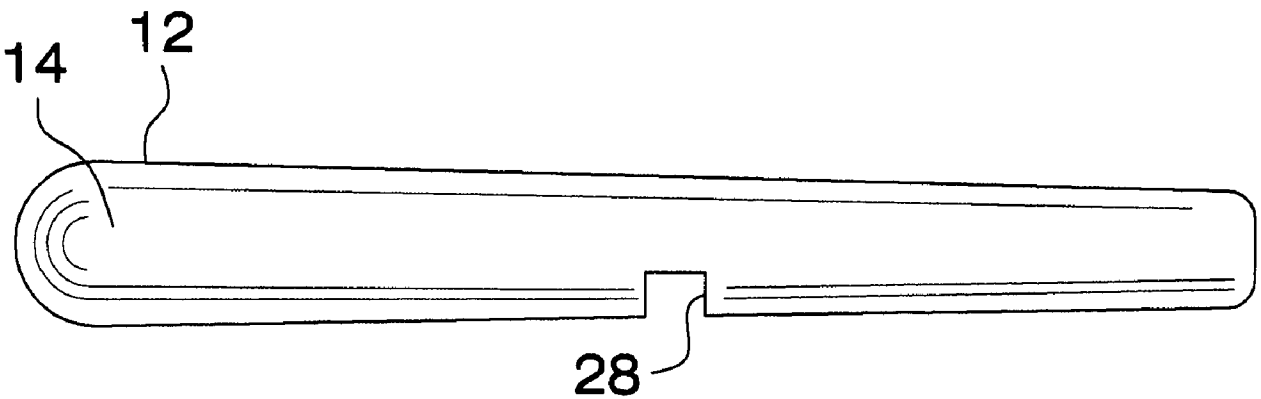
FIG. 5 is a top view of one of the arm assemblies of the present invention.
Figure 6:
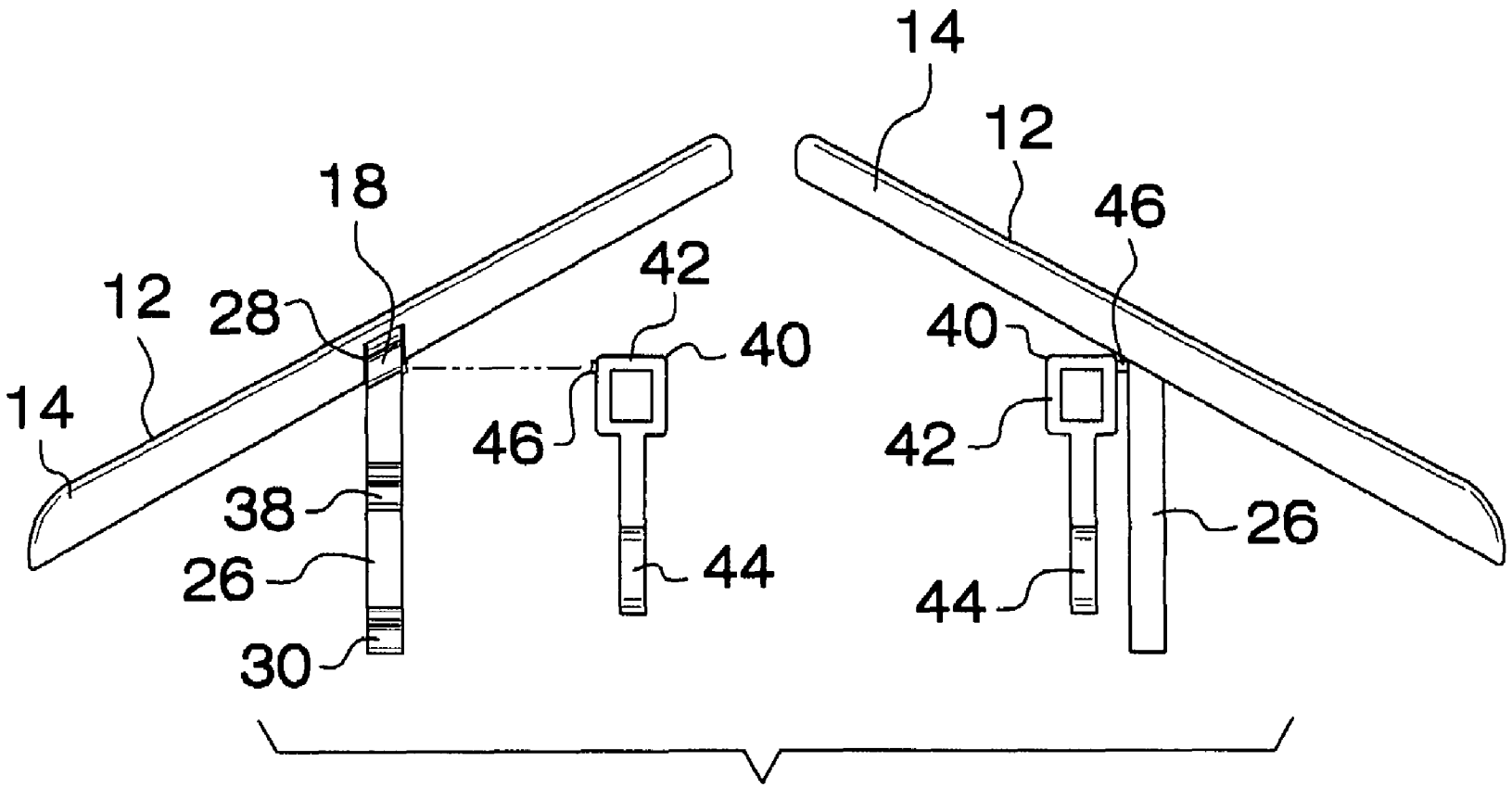
FIG. 6 is an exploded front view of the present invention.

With reference now to the drawings, and in particular to FIGS. 1 through 8 thereof, a new hanger attachment embodying the principles and concepts of the present invention and generally designated by the reference numeral 10 will be described.

As best illustrated in FIGS. 1 through 8, the shirt shoulder shaping system 10 generally comprises a pair of arm assemblies 12 being attached to a clothes hanger 1. The clothes hanger 1 has a pair of sides 2 each having one of the arm assemblies 12 attached thereto to distribute the weight of the shirt over a greater area of the shirt. Each of the arm assemblies 12 includes a cover 14 being positioned over one of a pair of descending arms 3 of the clothes hanger. The cover 14 distributes a portion of the weight of the shirt over the cover 14 when the shirt is hung on the clothes hanger 1. The cover 14 has a top side 16 having a convexly arcuate cross-section taken perpendicular to a longitudinal axis of the cover 14.

Each of the arm assemblies 12 also includes a plurality of mounting clips 18. Each of the mounting clips 18 is coupled to a bottom surface 20 of the cover 14. The mounting clips 18 engage the associated one of the descending arms 3 of the clothes hanger to secure the cover 14 to the associated one of the descending arms 3. Each of the mounting clips 18 is approximately C-shaped to define a first groove 22 for receiving the associated one of the descending arms 3. Each of the mounting clips 18 has a second groove 24 in communication with the first groove 22. The second groove 24 has a diameter smaller than a diameter of the first groove 22 to receive the associated one of the descending arms 3 too small to be securely received by the first groove 22. The first groove 22 receives the clothes hanger 1 made of a larger diameter material such as plastic while the second groove 24 receives smaller diameter material such as wire.

Each of the arm assemblies 12 also includes an extension arm 26 coupled to and downwardly extending from one of the mounting clips 18. The extension arm 26 is approximately centrally located with respect to opposite ends of the cover 14. The cover 14 has a cutout 28 extending into the cover 14. The cutout 28 is positioned adjacent the one of the mounting clips 18 with the extension arm 26 extending therefrom. The cutout 28 receives the extension arm 26 of the other one of the arm assemblies 12 to facilitate nesting of the arm assemblies 12 during storage.

Figure 7:
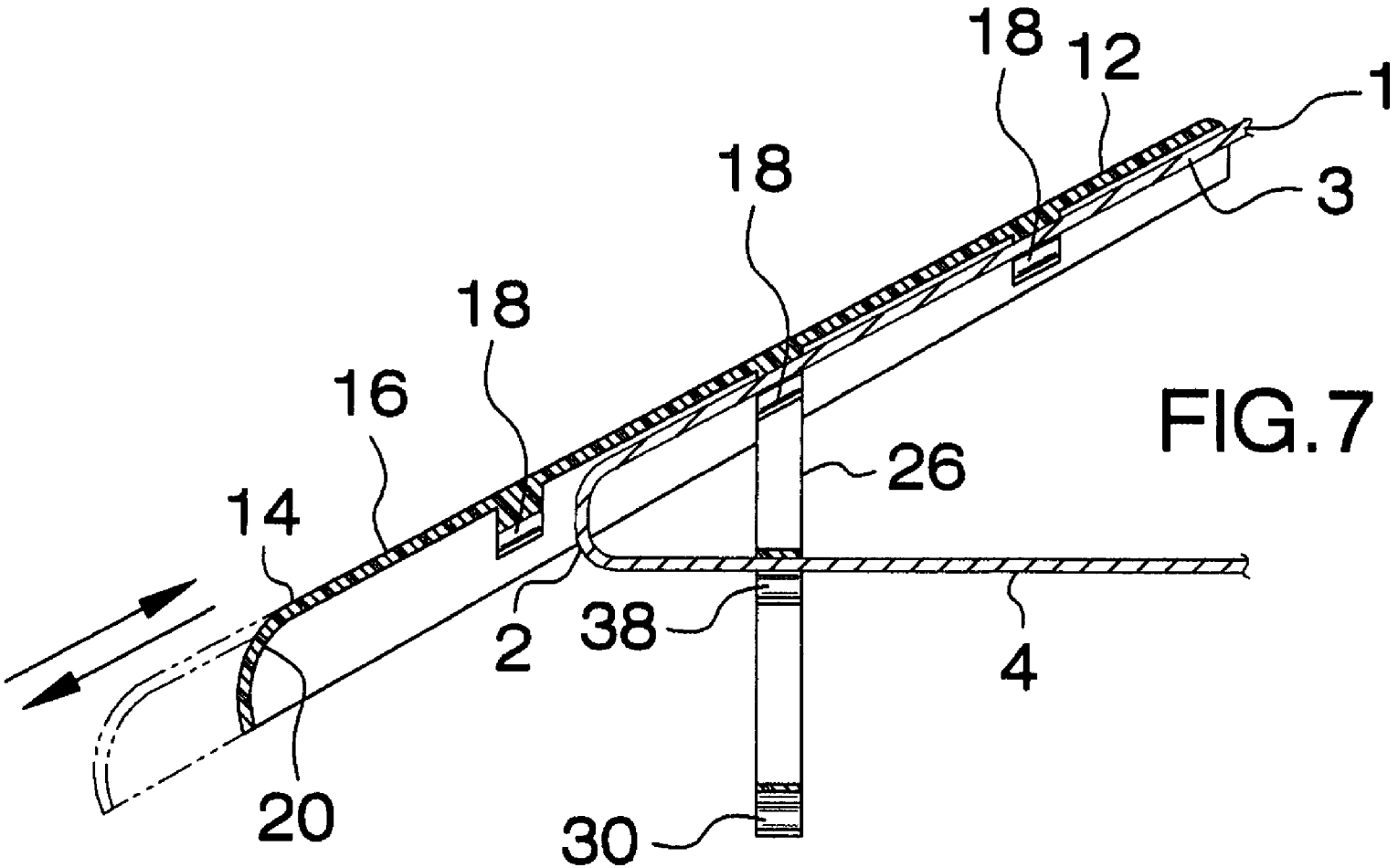
FIG. 7 is a cross-sectional view of one of the arm assemblies of the present invention taken along a longitudinal axis of the arm assembly showing the arm assembly extended from the hanger.
Figure 8:
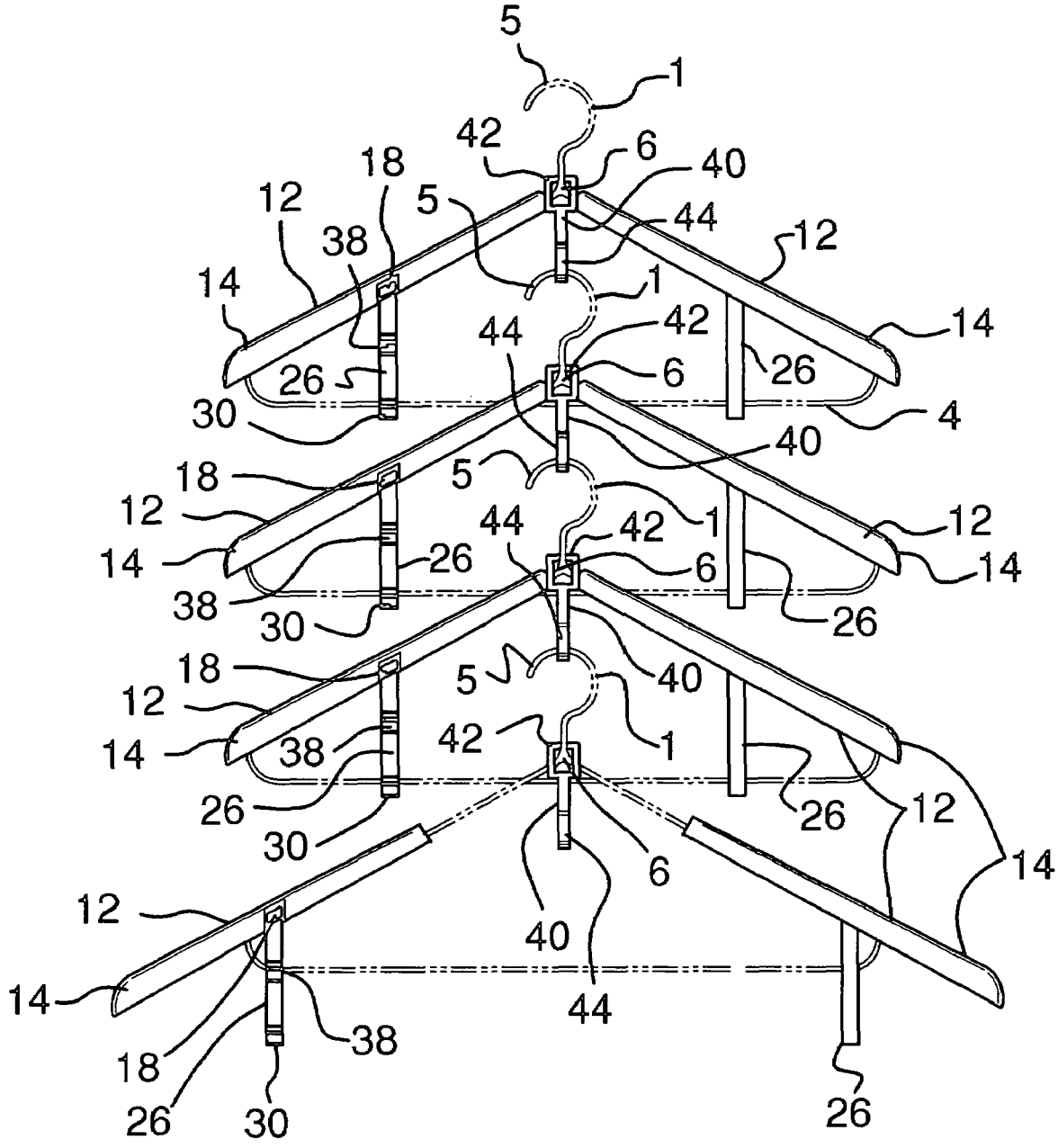
FIG. 8 is a front view of a plurality of the present inventions being used with multiple clothes hangers.

Each of the arm assemblies 12 additionally includes a primary securing clip 30 coupled to the extension arm 26 and engaging a bottom arm 4 of the clothes hanger 1 to inhibit rotation of the cover 14 around the associated one of the descending arms 3. The extension arm 26 also inhibits the associated on of the arm assemblies 12 from sliding off of the descending arm 3. The primary securing clip 30 is approximately C-shaped to define a first slot 32 for receiving the bottom arm 4. The primary securing clip 30 has a second slot 34 in communication with the first slot 32. The second slot 34 has a diameter smaller than a diameter of the first slot 32. The primary securing clip 30 is positioned adjacent to a bottom end 36 of the extension arm 26. The first slot 32 receives the clothes hanger 1 made of a larger diameter material such as plastic while the second slot 34 receives smaller diameter material such as wire. A secondary securing clip 38 is attached to the extension arm 26 and is positioned between the mounting clip and the primary securing clip 30. The secondary securing clip 38 has a same shape as the primary securing clip 30. As shown in FIG. 7, the secondary securing clip 38 is used to extend the cover 14 out further from the clothes hanger 1 for larger shirts.

A hook receiver 40 receives a hook 5 of the clothes hanger 1 and is suspended from a neck 6 of the clothes hanger 1. The hook receiver 40 receives the hook 5 of an adjacent clothes hanger 1 to allow the adjacent clothes hanger 1 to hang from the neck 6 of the clothes hanger 1. The hook receiver 40 includes a first ring 42 and a second ring 44 being spaced from each other and being attached to each other. The first ring 42 lies in a plane orientated perpendicular to a plane of the second ring 44. The hook 5 of the clothes hanger 1 is extendable through the first ring 42 and the hook 5 of an adjacent clothes hanger 1 is extendable through the second ring 44. The hook receiver 40 includes a frangible connector 46 extending between the first ring 42 and one of the arm assemblies 12 to store the hook receiver 40 prior to use of the hook receiver 40. The frangible connector 46 is broken to permit separation of the hook receiver 40 from the associated one of the arm assemblies 12.

In use, the mounting clips 18 of each of the arm assemblies 12 are used to secure the covers 14 to the descending arms 3 of the clothes hanger 1. The primary securing clips 30 are coupled to the bottom arm 4 of the clothes hanger 1 to inhibit rotation of the covers 14 around the descending arms 3. The shirt is then placed on the clothes hanger, as the shirt normally would be, wherein the covers 14 distribute the weight of the shirt over a greater area. For shirts of larger size, the secondary securing clips 38 are secured to the bottom arm 4 which extends the covers 14 past the sides 2 of the clothes hanger 1 to accommodate the greater size of shirt. For vertical stacking of a plurality of clothes hangers 1 the first ring 42 of the hook receiver 40 is slid over the hook 5 of the clothes hanger 1 and suspended from the neck 6 of the clothes hanger 1. The hook 5 of the adjacent clothes hanger 1 is then placed in the second ring 44 of the hook receiver 40 and allowed to hang from the hook receiver 40.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shirt shoulder shaping system for protecting a shirt being damaged by a clothes hanger that the shirt is hung on, said system comprising:

a pair of arm assemblies being attached to the clothes hanger, the clothes hanger having a pair of sides each having one of said arm assemblies attached thereto to distribute the weight of the shirt over a greater area of the shirt, each of said arm assemblies comprising:

a cover being positioned over one of a pair of descending arms of the clothes hanger, said cover distributing a portion of the weight of the shirt over the cover when the shirt is hung on the clothes hanger;

a plurality of mounting clips, each of said mounting clips being coupled to a bottom surface of said cover, said mounting clips engaging the associated one of the descending arms of the clothes hanger to secure said cover to the associated one of the descending arms, each of said arm assemblies includes an extension arm being coupled to and downwardly extending from one of said mounting clips;

a primary securing clip being coupled to said extension arm and engaging a bottom arm of the clothes hanger to inhibit rotation of said cover around the associated one of the descending arms, said primary securing clip is approximately C-shaped to define a first slot for receiving the bottom arm; and a secondary securing clip being attached to said extension arm and being positioned between said mounting clip and said primary securing clip, said extension arm having a first side and a second side, each of said primary and secondary clips being positioned on said first side of said extension arm, said primary securing clip has a second slot in communication with said first slot, said second slot having a diameter smaller than a diameter of said first slot, said primary securing clip being positioned adjacent to a bottom end of said extension arm.

2. The system according to claim 1, wherein said cover has a top side having a convexly arcuate cross-section taken perpendicular to a longitudinal axis of said cover.

3. The system according to claim 1, wherein each of said mounting clips is approximately C-shaped to define a first groove for receiving the associated one of the descending arms.

4. The system according to claim 3, wherein each of said mounting clips has a second groove in communication with said first groove, said second groove having a diameter smaller than a diameter of said first groove to receive the associated one of the descending arms too small to be securely received by said first groove.

5. The system according to claim 1, wherein said extension arm is approximately centrally located with respect to opposite ends of said cover.

6. The system according to claim 1, wherein said cover has a cutout extending into said cover, said cutout being positioned adjacent the one of said mounting clips with said extension arm extending therefrom, said cutout receiving said extension arm of the other one of said arm assemblies to facilitate nesting of said arm assemblies during storage.

7. The system according to claim 1, wherein said secondary securing clip has a same shape as said primary securing clip.

8. The system according to claim 1, further comprising a hook receiver receiving a hook of the clothes hanger and being suspended from a neck of the clothes hanger, said hook receiver receiving the hook of an adjacent clothes hanger to allow the adjacent clothes hanger to hang from the neck of the clothes hanger.

9. The system according to claim 8, wherein said hook receiver includes a first ring and a second ring being spaced from each other and being attached to each other, said first ring lying in a plane oriented perpendicular to a plane of said second ring, the hook of the clothes hanger being extendable through said first ring and the hook of an adjacent clothes hanger being extendable through said second ring.

10. The system according to claim 9, wherein said hook receiver includes a frangible connector extending between said first ring and one of said arm assemblies to store said hook receiver prior to use of said hook receiver, said frangible connector being broken to permit separation of said hook receiver from the associated one of said arm assemblies.

11. A shirt shoulder shaping system for protecting a shirt being damaged by a clothes hanger that the shirt is hung on, said system comprising:

a pair of arm assemblies being attached to the clothes hanger, the clothes hanger having a pair of sides each having one of said arm assemblies attached thereto to distribute the weight of the shirt over a greater area of the shirt, each of said arm assemblies comprising;

a cover being positioned over one of a pair of descending arms of the clothes hanger, said cover distributing a portion of the weight of the shirt over the cover when the shirt is hung on the clothes hanger, said cover having a top side having a convexly arcuate cross-section taken perpendicular to a longitudinal axis of said cover;

a plurality of mounting clips, each of said mounting clips being coupled to a bottom surface of said cover, said mounting clips engaging the associated one of the descending arms of the clothes hanger to secure said cover to the associated one of the descending arms, each of said mounting clips being approximately C-shaped to define a first groove for receiving the associated one of the descending arms, each of said mounting clips having a second groove in communication with said first groove, said second groove having a diameter smaller than a diameter of said first groove to receive the associated one of the descending arms too small to be securely received by said first groove;

an extension arm being coupled to and downwardly extending from one of said mounting clips, said extension arm being approximately centrally located with respect to opposite ends of said cover;

a primary securing clip being coupled to said extension arm and engaging a bottom arm of the clothes hanger to inhibit rotation of said cover around the associated one of the descending arms, said primary securing clip being approximately C-shaped to define a first slot for receiving the bottom arm, said primary securing clip having a second slot in communication with said first slot, said second slot having a diameter smaller than a diameter of said first slot, said primary securing clip being positioned adjacent to a bottom end of said extension arm;

a secondary securing clip being attached to said extension arm and being positioned between said mounting clip and said primary securing clip, said secondary securing clip having a same shape as said primary securing clip; and a hook receiver receiving a hook of the clothes hanger and being suspended from a neck of the clothes hanger, said hook receiver receiving the hook of an adjacent clothes hanger to allow the adjacent clothes hanger to hang from the neck of the clothes hanger, said hook receiver includes a first ring and a second ring being spaced from each other and being attached to each other, said first ring lying in a plane oriented perpendicular to a plane of said second ring, the hook of the clothes hanger being extendable through said first ring and the hook of an adjacent clothes hanger being extendable through said second ring, said hook receiver including a frangible connector extending between said first ring and one of said arm assemblies to store said hook receiver prior to use of said hook receiver, said frangible connector being broken to permit separation of said hook receiver from the associated one of said arm assemblies.

* * * * *